US008540319B2

(12) United States Patent
Hanaoka

(10) Patent No.: US 8,540,319 B2
(45) Date of Patent: Sep. 24, 2013

(54) BIT REPLACING DEVICE FOR EXCAVATING MACHINE

(75) Inventor: Yasuharu Hanaoka, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 0 days.

(21) Appl. No.: 13/520,352

(22) PCT Filed: Dec. 16, 2010

(86) PCT No.: PCT/JP2010/072604

§ 371 (c)(1),
(2), (4) Date: Jul. 3, 2012

(87) PCT Pub. No.: WO2010/092964

PCT Pub. Date: Aug. 4, 2011

(65) Prior Publication Data

US 2012/0274122 A1 Nov. 1, 2012

(30) Foreign Application Priority Data

Jan. 29, 2010 (JP) ..... 2010-017520

(51) Int. Cl.
*E21D 9/11* (2006.01)

(52) U.S. Cl.
USPC ..... 299/58; 299/106

(58) Field of Classification Search
USPC ..... 299/55, 56, 58, 106, 110; 405/144, 405/147
See application file for complete search history.

(56) References Cited

U.S. PATENT DOCUMENTS

| | | | | |
|---|---|---|---|---|
| 4,193,637 | A * | 3/1980 | Spencer | 299/56 |
| 4,234,235 | A * | 11/1980 | Robbins et al. | 299/56 |
| 6,347,838 | B1 * | 2/2002 | Mukaidani et al. | 299/55 |
| 6,382,732 | B1 * | 5/2002 | Tanaka et al. | 299/55 |

FOREIGN PATENT DOCUMENTS

| | | |
|---|---|---|
| JP | 2000-096987 | 4/2000 |
| JP | 3139749 | 12/2000 |
| JP | 2002-276290 | 9/2002 |
| JP | 2004-211477 | 7/2004 |
| JP | 2004-218298 | 8/2004 |
| JP | 4163965 | 8/2008 |

OTHER PUBLICATIONS

Int'l Search Report from corresponding Int'l Patent Application No. PCT/JP2010/072604, 2 Pages.

* cited by examiner

*Primary Examiner* — David Bagnell
*Assistant Examiner* — Michael Goodwin
(74) *Attorney, Agent, or Firm* — Kusner & Jaffe

(57) ABSTRACT

A valve containing portion (35) is formed behind a bit containing portion (34) which opens at the front surface of a main cutter spoke (21). A rotary valve (39) is rotatably disposed in the valve containing portion (35). A bit case (41) containing a roller bit (31) is moved so as to protrude from an attachment/detachment path (39) formed in a rotary valve (38) into the bit containing portion (34), and is fixed by a cotter (38) to support an excavating reactive force. Thus, the sliding gap of the rotary valve (39) is disposed in the bit containing portion (34) and the valve containing portion (35) to be covered with the bit case (41).

4 Claims, 12 Drawing Sheets

BIT REPLACING DEVICE FOR EXCAVATING MACHINE

TECHNICAL FIELD

The present invention relates to a device for replacing an excavating bit in which a roller bit (disk cutter) abraded by crushing rocks and pebbles during excavation can be replaced from a workspace provided in a cutter head of an excavating machine such as a shield machine.

BACKGROUND ART

As a technique for a bit replacing device which replaces the abraded roller bit for another roller bit from the workspace formed in the cutter head during excavation, for example, Patent Literature 1 and Patent Literature 2 have been proposed. The bit replacing devices each include a rotor having an opening and disposed on the front surface of a cutter spoke. A roller bit is disposed in the opening of the rotor. When replacing the roller bit, the rotor is turned by 90° or 180° to cause the opening of the rotor to face an opening for replacement provided on the side surface side or rear surface side of the opening of the rotor. Thus, the roller bit is removed out from the opening of the rotor into the workspace via the opening for replacement.

CITATION LIST

Patent Literatures

Patent Literature 1: Japanese Patent No. 3139749
Patent Literature 2: Japanese Patent No. 4163965

SUMMARY OF INVENTION

Technical Problem

In the conventional literatures, however, the rotor is disposed on the front surface of the cutter head (cutter spoke), and a sliding gap between the rotor and its supporting member is exposed so as to face the front surface of the cutter head. Thus, during excavation, muddy water pressure may be directly applied to the sliding gap or fragments of pebbles and the like may enter the gap. Accordingly, a sealing material provided at the sliding gap may be easily broken to impede the rotation of the rotor.

The present invention has been devised to solve the above problem. An object of the present invention is to provide a bit replacing device for an excavating machine which can improve sealing properties at the sliding gap of a rotor including a roller bit and replace the roller bit by smoothly rotating the rotor during excavation.

Solution to Problem

In order to solve the problem, the invention of a first aspect is a bit replacing unit for an excavating machine, in which the excavating machine includes, in the front part thereof, a cutter head rotatably supported about an excavating machine axial center, a roller bit for crushing rocks and pebbles, the roller bit being disposed on the front surface of the cutter head, and a workspace in which the abraded roller bit can be replaced, the workspace being formed inside the cutter head, wherein a housing is disposed in the front part of the cutter head, a bit containing path is formed in the housing along an in-and-out axis along which the roller bit is extended and retracted, a bit containing portion which opens at the front surface of the cutter head and a valve containing portion which is formed behind the bit containing portion are provided on the bit containing path, an opening for replacement is formed in the direction of an insertion-and-removal axis at a predetermined angle with relative to the in-and-out axis in the housing, the opening for replacement communicating with the valve containing portion and the workspace, a rotary valve is provided in the valve containing portion, the rotary valve being rotatable about a rotary axis substantially perpendicular to the in-and-out axis and the insertion-and-removal axis, an attachment/detachment path communicating with the bit containing portion is formed in the rotary valve, a bit case containing the roller bit is removably inserted into the attachment/detachment path, the rotary valve is turned at a predetermined angle to cause the attachment/detachment path to communicate with the opening for replacement, so that the bit case is movable between the attachment/detachment path and the workspace, a bit extending/retracting mechanism for extending and retracting the bit case between the attachment/detachment path and the bit containing portion is provided on the rotary valve, a first sealing material is provided for sealing at a gap between the bit case and the valve containing portion, and a second sealing material is provided for sealing at a gap between the periphery of the opening of the attachment/detachment path and the inner surface of the valve containing portion on the outer peripheral surface of the rotary valve.

The invention of a second aspect is the bit replacing unit for an excavating machine according to the first aspect wherein a reactive force support block is provided on the rear surface side of the bit case in the attachment/detachment path of the rotary valve, the reactive force support block transferring the excavating reactive force of the roller bit to the housing, and a cotter for transferring the excavating reactive force is removably fitted between the bit case and the reactive force support block in the valve containing portion.

The invention of a third aspect is the bit replacing unit for an excavating machine according to the first or second aspect, wherein the bit containing path penetrates through the cutter head, the attachment/detachment path penetrates through the rotary valve, the reactive force support block is removably inserted into the attachment/detachment path, and the reactive force support block is removably inserted into the workspace from the rear opening of the attachment/detachment path of the rotary valve via the opening for replacement.

The invention of a fourth aspect is the bit replacing unit for an excavating machine according to the third aspect, wherein a first soil removal path containing the roller bit penetrates through the bit case in the direction of the in-and-out axis, a second soil removal path communicating with the first soil removal path penetrates through the reactive force support block in the direction of the in-and-out axis, and soil excavated by the roller bit can be discharged from the first soil removal path to the rear surface side of the cutter head via the second soil removal path.

Advantageous Effects of Invention

According to the configuration of the first aspect, the valve containing portion containing the rotary valve is formed behind the bit containing portion which opens at the front surface of the cutter head, and the bit case including the roller bit is moved from the attachment/detachment path of the rotary valve so as to protrude into the bit containing portion. Thus, a sliding gap between the rotary valve and the valve containing portion is covered by the bit case and is not exposed to the front surface of the cutter head. Further, the first sealing material stops water at a gap between the bit containing portion and the bit case, and muddy water pressure is supported by the first sealing material during excavation. Thus, fragments of pebbles and the like do not enter the gap between the rotary valve and the valve containing portion together with muddy water and muddy water pressure is not directly applied to the second sealing material during excavation. Hence, the sliding gap between the rotary valve and the valve containing portion can be favorably sealed, so that the rotary valve can be smoothly rotated when replacing the abraded roller bit.

According to the configuration of the second aspect, the excavating reactive force transferred from the bit case via the cotter can be supported by the housing via the reactive force support block on the rear surface side of the attachment/detachment path. Thus, a large excavating reactive force can be effectively supported.

According to the configuration of the third aspect, the reactive force support block is first removed from the attachment/detachment path, and then the bit case is removed from the attachment/detachment path, so that the roller bit can be easily replaced. Further, options for the rotation direction of the rotary valve can be increased.

According to the configuration of the fourth aspect, soil excavated by the roller bit can be smoothly discharged from the first soil removal path to the rear surface side of the cutter head via the second soil removal path, so that rocks and pebbles can be favorably crushed.

DESCRIPTION OF EMBODIMENTS

Embodiments of the present invention will be described.

First Embodiment

The following will describe an embodiment of a bit replacing unit which is a bit replacing device for a shield machine (excavating machine) according to the present invention.

First Embodiment

A first embodiment will be described with reference to FIGS. 1 to 16.

[Shield Machine]

Figure 12:
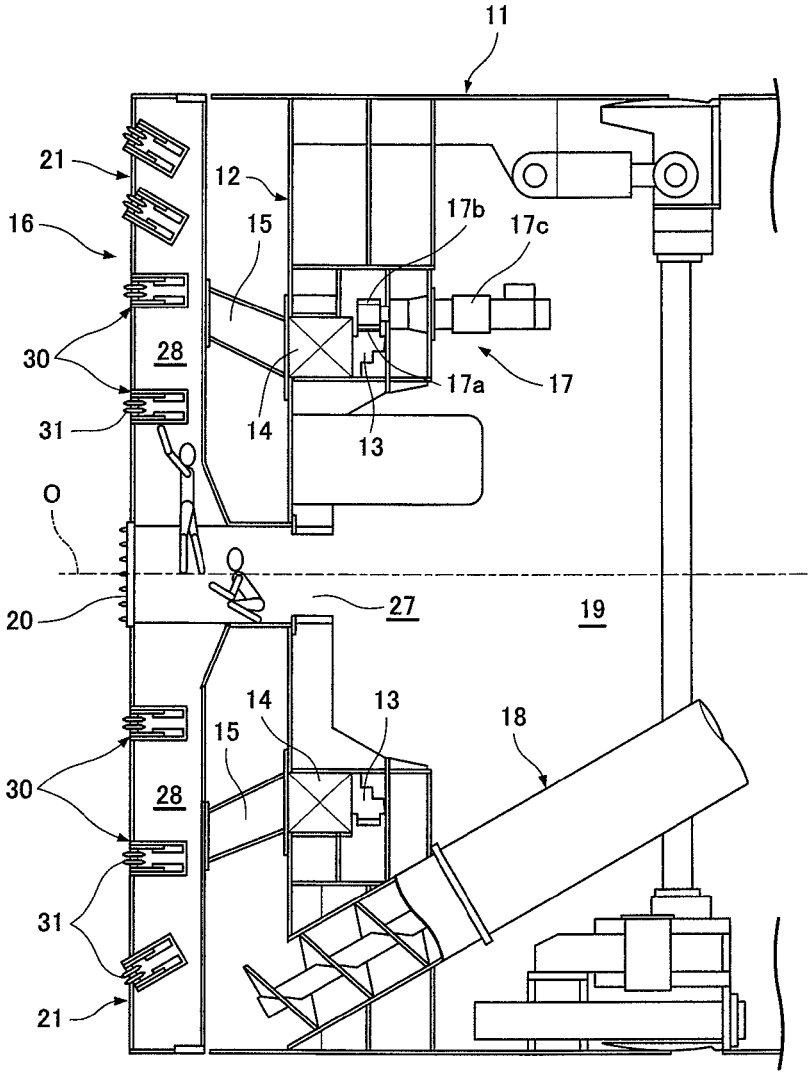
FIG. 12 is a central longitudinal sectional view illustrating the shield machine having the bit replacing units.

As shown in FIG. 12, a pressure bulkhead 12 keeping a face colluvium pressure is provided in the front part of a cylindrically-shaped shield body (excavating machine body) 11, and a rotary ring body 14 is supported by the pressure bulkhead 12 via a rotary bearing 13 so as to rotate about shield axial center O (excavating machine axial center). A circular cutter head 16 is supported at the front ends of a plurality of support legs 15 projecting forward from the rotary ring body 14. An atmospheric pressure chamber 19 kept at atmospheric pressure is provided behind the pressure bulkhead 12. A cutter drive device 17 for rotationally driving the cutter head 16 is provided in the atmospheric pressure chamber 19. The cutter drive device 17 includes a ring gear 17*a* provided on the backside of the rotary ring body 14, a plurality of drive pinions 17*b* engaged with the ring gear 17*a*, and a plurality of rotation drive devices (hydraulic or electric motors) 17*c* for rotationally driving the drive pinions 17*b*. A screw conveyor for soil removal 18 is provided on the pressure bulkhead 12 to discharge soil excavated by the cutter head 16 from the front part of the pressure bulkhead 12 toward the atmospheric pressure chamber 19 while keeping the face colluvium pressure.

Figure 11:
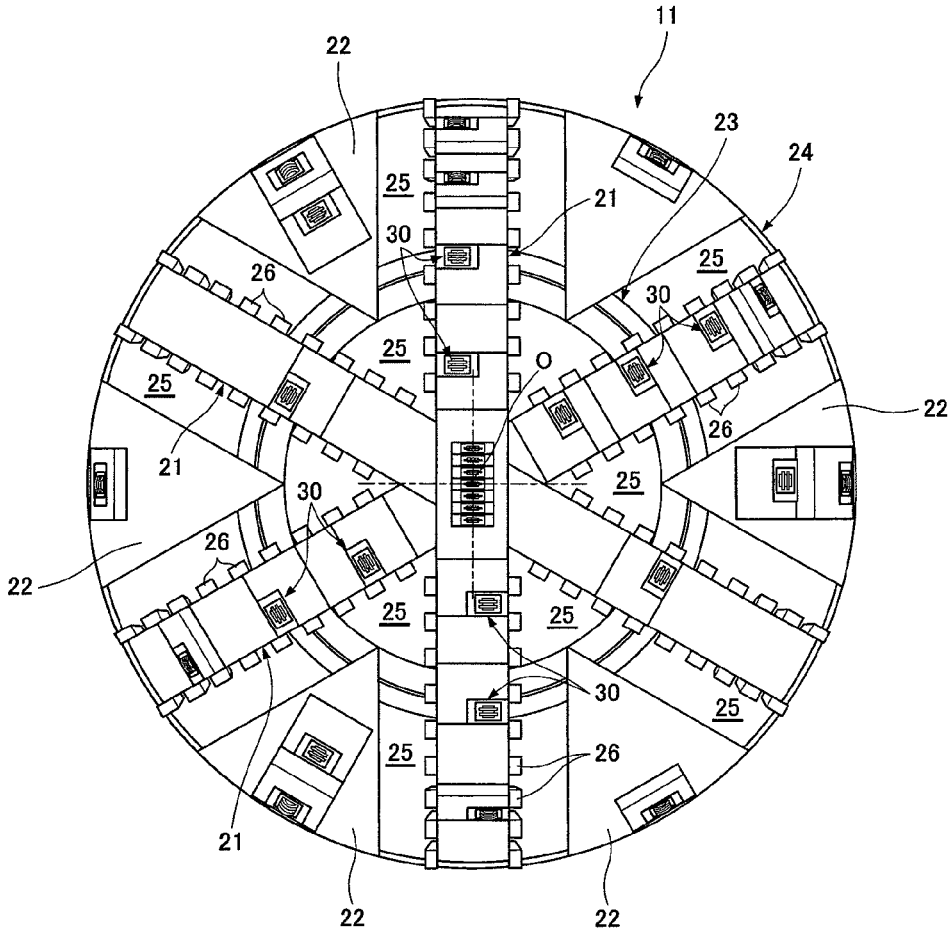
FIG. 11 is a front view illustrating a cutter head of a shield machine having bit replacing units.

As shown in FIG. 11, the cutter head 16 includes a plurality of main spoke members 21 extended along a radial direction from a center member 20 disposed on the shield axial center O, a plurality of sectorial intermediate face plates 22 disposed between the main spoke members 21, and an intermediate ring member 23 and an outer peripheral ring member 24 which are placed in a circumferential direction centered about the shield axial center O to connect the main spoke members 21 and the intermediate face plates 22. Soil inlets 25 for introducing excavated soil are formed between the members 21 to 24.

A plurality of bit replacing units 30 according to the present invention are arranged on the main spoke member 21. A roller bit 31 for crushing rocks and pebbles is provided on each bit replacing unit 30 so as to be rotatable about an axis in a radial direction of the shield body 11. The roller bits 31 on all the bit replacing units 30 are positioned such that the turning radii from the shield axial center O are different from each other. Thus, the roller bits 31 can excavate and crush different turning regions. A center roller bit is provided on the center member 20, and a plurality of fixed bits 26 are provided on two sides of each main spoke member 21.

As shown in FIG. 12, a manhole 27 is provided behind the center member 20 so as to face the atmospheric pressure chamber 19. The manhole 27 passes through the pressure bulkhead 12 and communicates with a workspace 28 in the main spoke member 21 from the atmospheric pressure chamber 19, so that an operator can enter and exit the workspace 28 through the manhole 27.

First Embodiment of Bit Replacing Unit

A first embodiment of the bit replacing unit will be described with reference to FIGS. 1 to 10 and 13 to 16.

Figure 1:
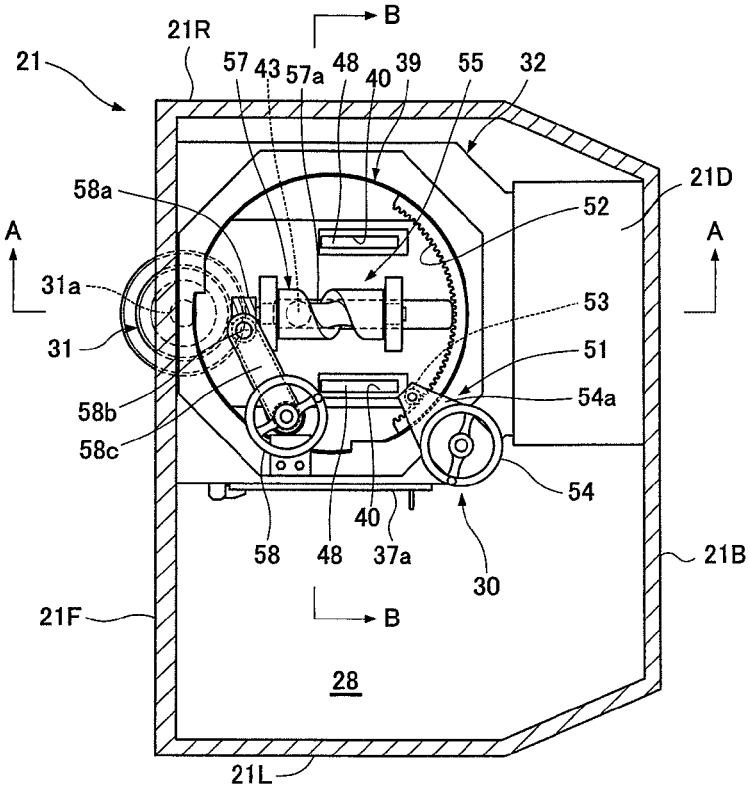
FIG. 1 is a cross-sectional view of a main cutter spoke illustrating a first embodiment of a bit replacing unit according to the present invention.

As shown in FIG. 1, the main spoke member 21 is a hollow member with a front surface plate 21F, a rear surface plate 21B, and left and right side surface plates 21L and 21R. The main spoke member 12 has a substantially trapezoidal cross-section in which the rear parts of the left and right sides surface plates 21L and 21R are inclined inward. The bit replacing unit 30 is disposed at a predetermined distance from the center of the main spoke member 21 on one side in the width direction thereof, and the workspace 28 is formed on the other side in the width direction of the main spoke member 21, when the main spoke member 21 is viewed from the front.

Figure 2:
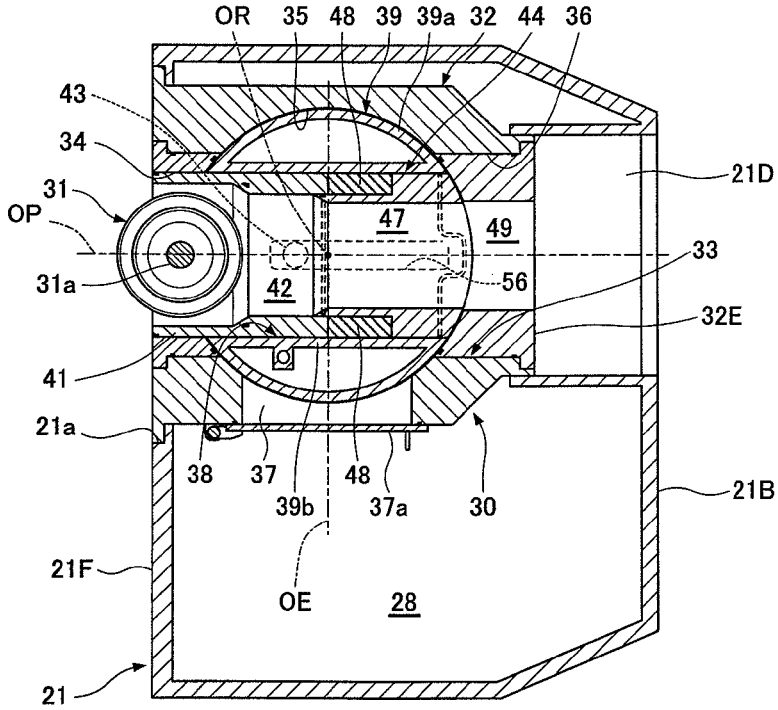
FIG. 2 is a central cross-sectional view of the bit replacing unit.
Figure 3:
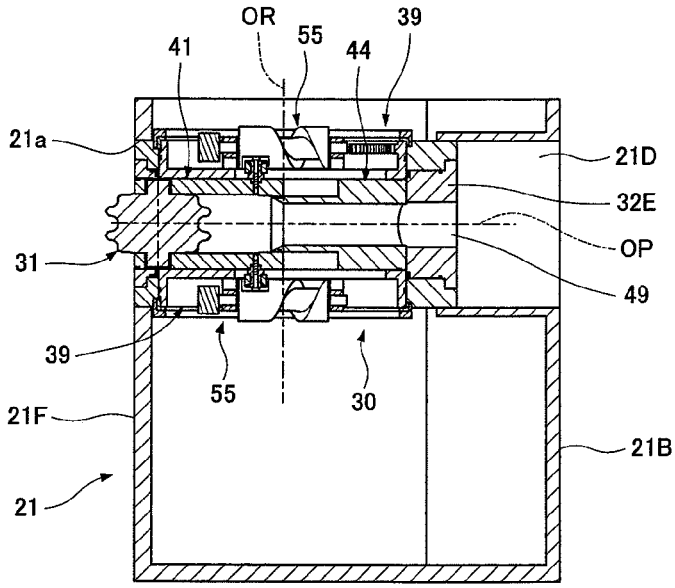
FIG. 3 is a cross-sectional view taken along the arrows A-A of FIG. 1.
Figure 4:
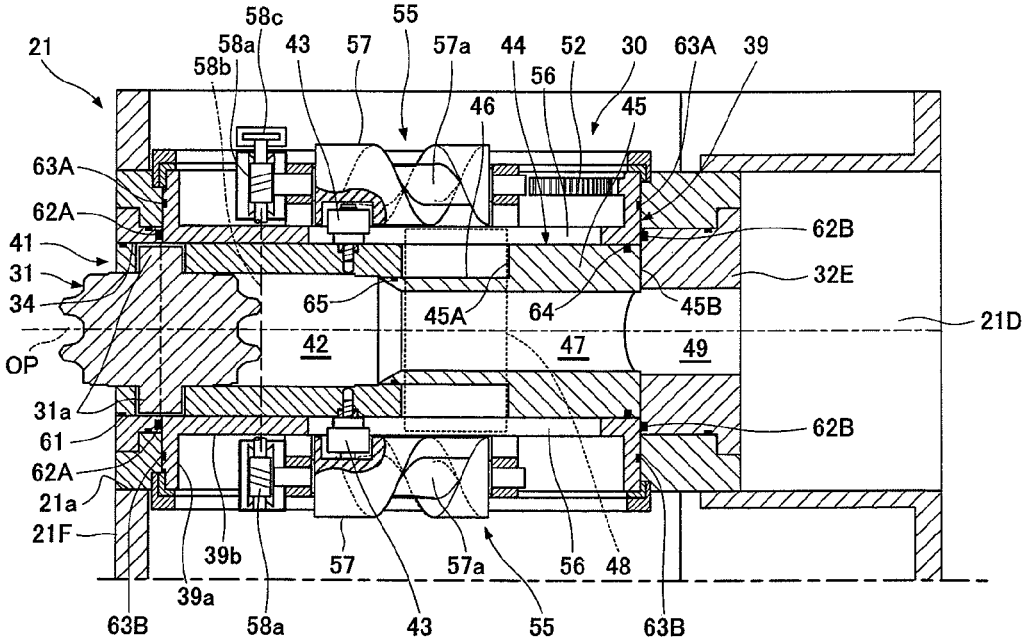
FIG. 4 is an enlarged view of the major part of FIG. 3.

As shown in FIGS. 2 to 4, the bit replacing unit 30 includes a housing 32 connecting a mounting opening 21*a* formed on the front surface plate 21F and a duct for soil removal 21D penetrating through the rear surface plate 21B. A bit containing passage 33, which communicates with the duct for soil removal 21D, penetrates through the housing 32 along an in-and-out axis OP parallel to the shield axial center O and perpendicular to the front surface of the cutter head 16. On the bit containing passage 33, there are formed a bit containing portion 34 which opens at the front surface of the main spoke member 21, a cylindrical valve containing portion 35 formed around the radial axis (an axis of rotation which will be described later) OR behind the bit containing portion 34, and a plug containing portion 36 formed behind the valve containing portion 35 with a reactive force support plug 32E fitted and fixed to the plug containing portion 36. The housing 32 includes an opening for replacement 37 which communicates with the valve containing portion 35 and the workspace 28, the opening for replacement 37 being formed along a tangent axis (an insertion-and-removal axis which will be described later) OE intersecting with the in-and-out axis OP and the radial axis OR extended along the radial direction of the cutter head 16. A door for replacement 37*a* is attached to the opening for replacement 37 via a hinge so as to be openable and closable.

In the present embodiment, the in-and-out axis OP is parallel to the shield axial center O. The cutter head on which the roller bit 31 is provided has a front surface plate. The outer peripheral side of the front surface plate may be inclined or curved rearward. Further, the roller bit is provided so as to extend and retract substantially perpendicular (for example, 85° to 95°) to the front surface plate of the cutter head. Alternatively, the roller bit is provided so as to extend and retract while being tilted at a predetermined angle of, for example, about 45° to 85° relative to the front surface of the cutter head. In such cases, even when the in-and-out axis OP of the roller bit is positioned substantially perpendicular to the front surface plate of the cutter head, the in-and-out axis OP of the roller bit is not parallel to the shield axial center O but tilted at a predetermined angle relative to the shield axial center O.

Moreover, the opening for replacement 37 is formed in the direction of the tangent axis OE perpendicularly intersecting with the in-and-out axis OP and the radial axis OR. The opening for replacement 37 may be inclined at a predetermined angle relative to the tangent axis OE, for example, in a range of 15° forward to 60° rearward, as long as the roller bit 31 and a reactive force support block 44 can be extended and retracted, which will be described later, and the roller bit 31 and the reactive force support block 44 can be contained in the space of the main cutter spoke 21.

A cylindrical rotary valve 39 is placed in the valve containing portion 35 so as to freely rotate about the radial axis OR. The rotary valve 39 includes a cylindrical outer peripheral plate 39*a* and an expanding cylinder 39*b* which penetrates through the outer peripheral plate 39*a* in the diameter direction thereof to form an attachment/detachment path 38. The attachment/detachment path 38 has an elliptical cross-section whose longer diameter is formed along the tangent axis OE, and has a front surface opening communicated with the bit containing portion 34. Further, the attachment/detachment path 38 has a larger diameter than that of a soil removal path 49 of the reactive force support plug 32E. The rotary valve 39 is rotated to turn the attachment/detachment path 38 by 90° from a use position, so that the attachment/detachment path 38 can be communicated with the opening for replacement 37 while taking up a replacement position along the tangent axis OE.

Furthermore, in the present embodiment, the radial axis OR as the rotation center of the rotary valve 39 perpendicularly intersects with the in-and-out axis OP and the tangent axis OE. However, the radial axis OR may intersect with the shield axial center O and the tangent axis OE at about 90° (for example, 85° to 95°) to rotate the rotary valve 39.

(Bit Case and Reactive Force Support Block)

Figure 8:
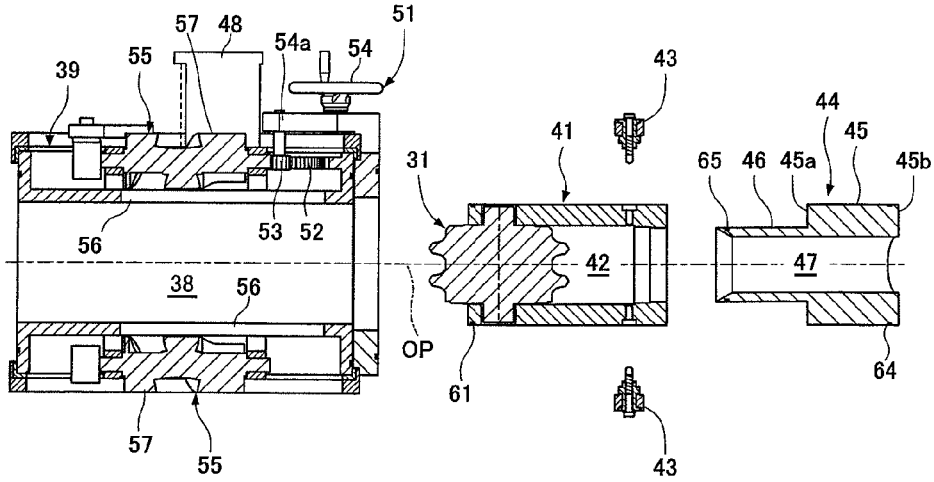
FIG. 8 is an exploded longitudinal sectional view illustrating a state in which a bit case and a reactive force support block are removed from a rotary valve.

As shown in FIG. 8, a bit case 41 containing the roller bit 31 and the reactive force support block 44 are removably inserted into the attachment/detachment path 38. The reactive force support block 44 causes the housing 32 to support excavating reactive force applied from the roller bit 31 via the bit case 41, from the reactive force support plug 32E.

Figure 7:
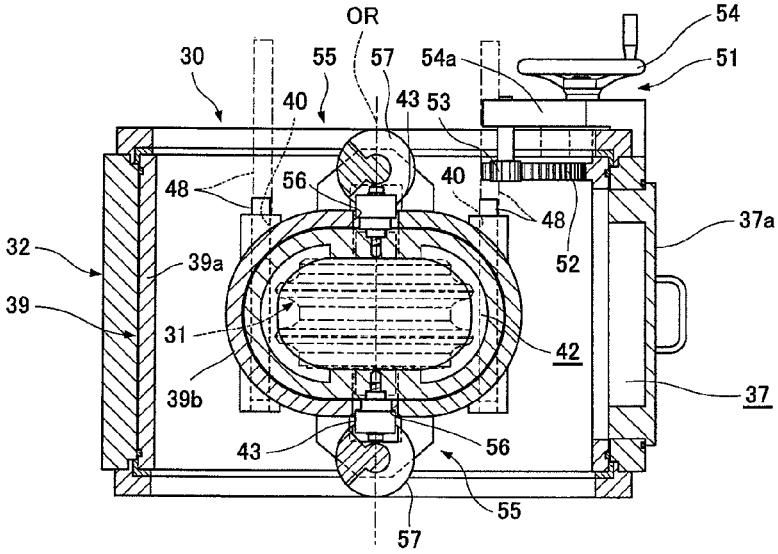
FIG. 7 is a cross-sectional view taken along the arrows B-B of FIG. 1.
Figure 9:
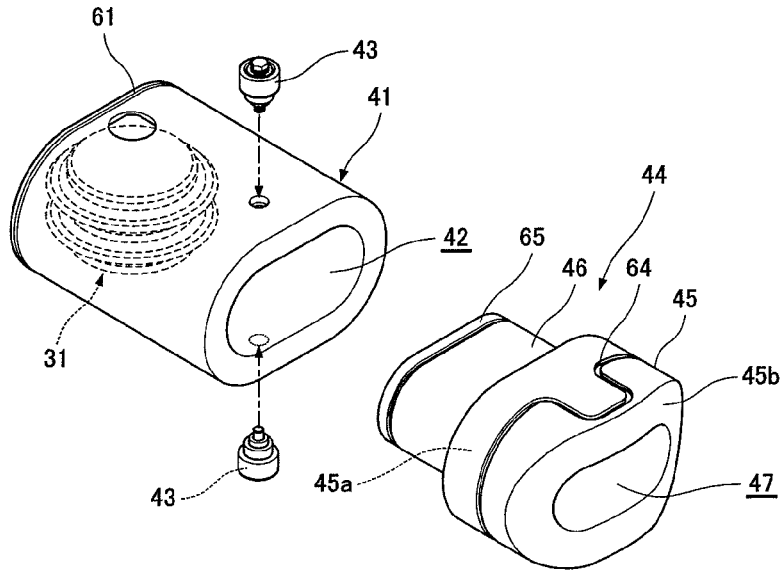
FIG. 9 is an exploded perspective view illustrating the bit case and the reactive force supporting block.

As shown in FIGS. 7 and 9, the bit case 41 is cylindrically-shaped to have an elliptical cross-section, a soil removal path 42 having an elliptical cross-section penetrates through the bit case 41 along the in-and-out axis OP, and the roller bit 31 is rotatably supported by the front part of the soil removal path 42 via an axial portion 31*a* parallel to the radial axis OR. A pair of cam rollers 43 shown in FIG. 4 is detachably provided so as to protrude at the symmetric positions of the radial axis OR on the rear part of the bit case 41.

The reactive support block 44 includes a block body 45 with a large diameter which is fitted into the attachment/detachment path 38, and a guide cylinder 46 with a small diameter which protrudes from a reactive force receiving surface 45*a* on the front surface of the block body 45 and is slidably fitted into the soil removal path 42 of the bit case 41.

The block body 45 and the guide cylinder 46 are cylindrically-shaped to have an elliptical cross-section, and a soil removal path 47 having an elliptical cross-section along the in-and-out axis OP penetrates through the block body 45 and the guide cylinder 46. Further, an arc-like reactive force transmission surface 45*b* is formed along the outer peripheral surface of the rotary valve 39 on the rear end surface of the block body 45.

Figure 13:
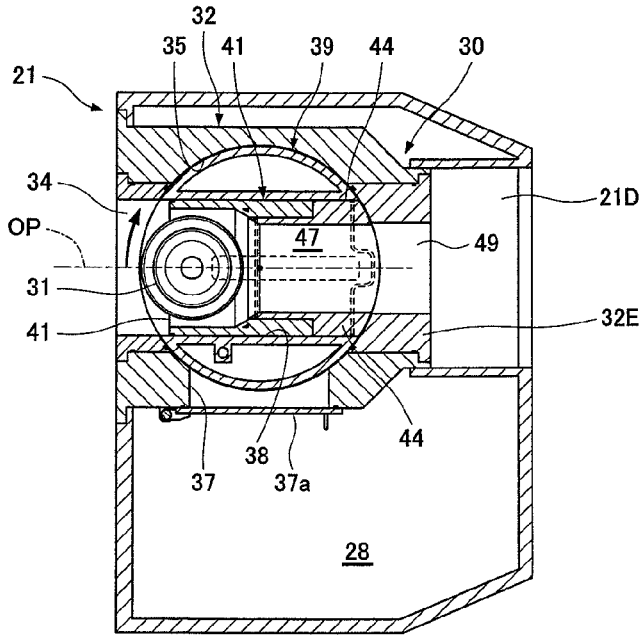
FIG. 13 is a central cross-sectional view of the bit replacing unit illustrating the retraction position of the bit case in the replacement of a roller bit.
Figure 14:
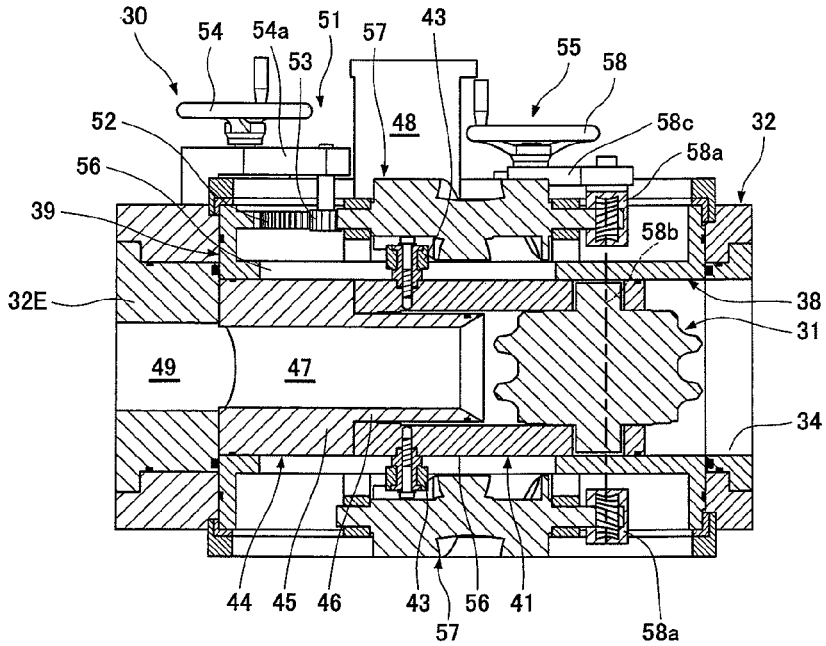
FIG. 14 is a central longitudinal sectional view of the bit replacing unit illustrating the retraction position of the bit case in the replacement of the roller bit.
Figure 15:
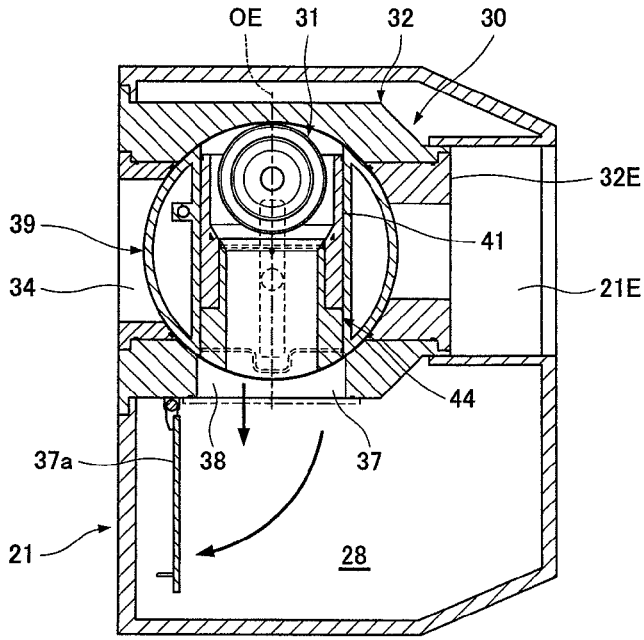
FIG. 15 is a central cross-sectional view of the bit replacing unit illustrating the replacement position of the rotary valve in the replacement of the roller bit.
Figure 16:
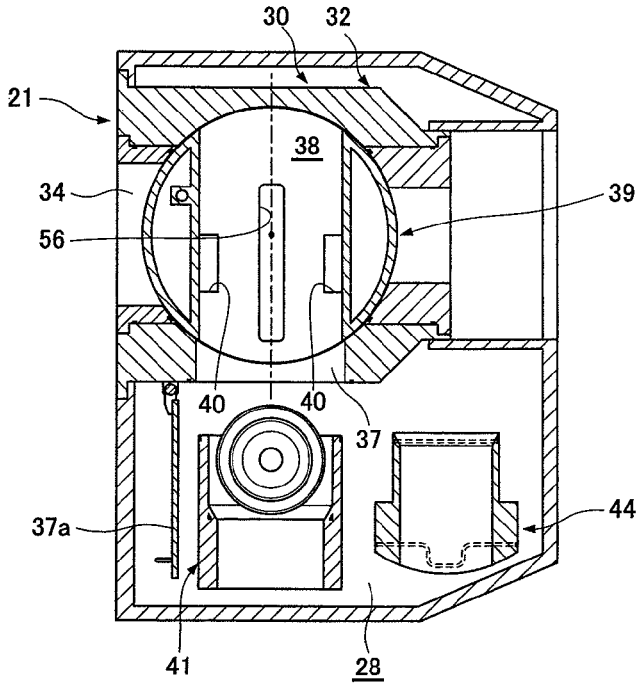
FIG. 16 is a central cross-sectional view of the bit replacing unit illustrating a state in which the bit case and the reactive force support block are removed out in the replacement of the roller bit.

Thus, as shown in FIG. 13, the attachment/detachment path 38 in the use position parallel to the shield axial center O is aligned with the bit containing portion 34, the bit case 41, the reactive force support block 44, and the reactive force support plug 32E of the housing 32. The soil removal path 42, the soil removal path 47, the soil removal path 49, and the duct for soil removal 21D linearly communicate with each other. In the replacement position of FIG. 15 in which the rotary valve 39 is turned by 90° about the radial axis OR in the arrow direction of FIG. 13, the bit case 41 and the reactive force support block 44 are inserted or removed for replacement between the attachment/detachment path 38 communicated with the opening for replacement 37 and the workspace 28.

Reference numeral 48 in FIG. 7 denotes a pair of left and right cotters interposed between the bit case 41 protruding into the bit containing portion 34 and the reactive force receiving surface 45*a* of the block body 45. The cotters 48 are interposed between the rear surface of the bit case 41 and the reactive force receiving surface 45*a* of the block body 45 in an excavation position where the bit case 41 is moved so as to protrude into the bit containing portion 34 to fix the bit case 41. The cotters 48 are removably fitted into cotter inserting holes 40 which are formed in the direction of the short diameter of the attachment/detachment path 38. The cotter inserting holes 40 penetrate through the expanding cylinder 39*b* in the direction of the radial axis OR. The cotters 48 transfer the excavating reactive force of the roller bit 31 from the bit case 41 to the reactive force support block 44. Further, the excavating reactive force is transferred from the reactive force transmission surface 45*b* of the reactive force support block 44 to the reactive force support plug 32E of the housing 32.

(Valve Rotating Mechanism and Bit Extending/Retracting Mechanism)

Figure 5:
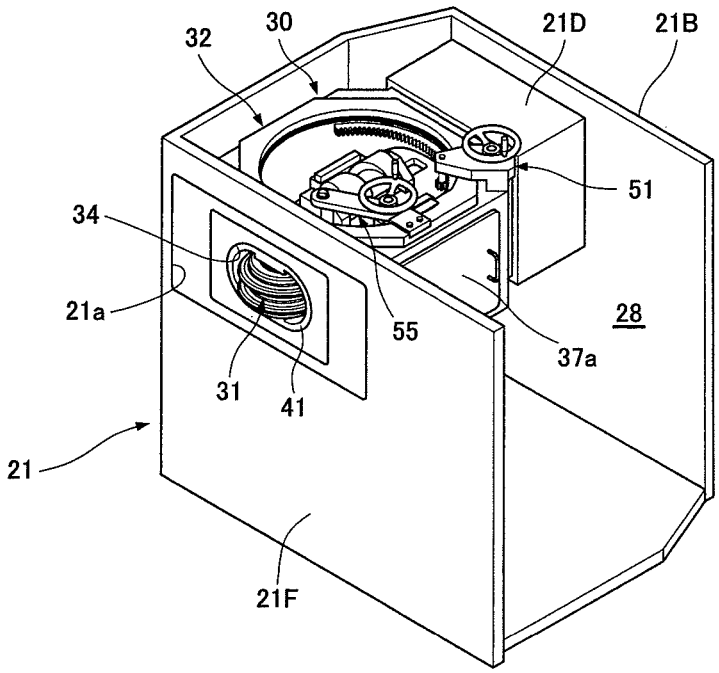
FIG. 5 is a partially cutaway perspective view of the main cutter spoke illustrating the bit replacing unit.
Figure 6:
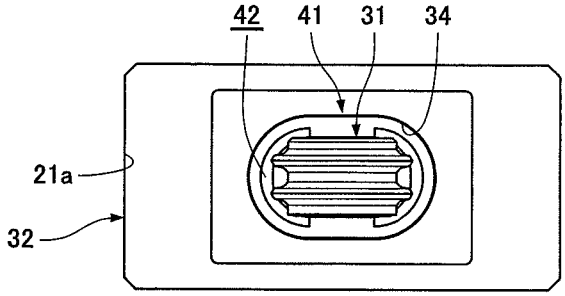
FIG. 6 is a front view illustrating the bit replacing unit.

As shown in FIGS. 1, 5, and 7, the bit replacing unit 30 includes: a valve rotating mechanism 51 provided in the housing 32 to turn the rotary valve 39 between the use position and the replacement position; and a bit extending/retracting mechanism 55 provided on the rotary valve 39 to extend and retract the bit case 41 between an excavation position and a retraction position in the attachment/detachment path 38.

The valve rotating mechanism 51 includes: an arc-like internal gear rack 52 attached to the inner surface of the outer peripheral plate 39*a* of the rotary valve 39 within a predetermined range; a pinion 53 rotatably supported by the housing 32 via a supporting member and engaged with the internal gear rack 52; and a valve rotating handle 54 for rotating the pinion 53 via a driving mechanism with a wrapping connector 54*a* composed of a chain and a sprocket.

The bit extending/retracting mechanism 55 includes: the pair of cam rollers 43 protruding in the symmetric position of the bit case 41; guide holes 56 formed in an extending/retracting direction on the expanding cylinder 39*b* of the rotary valve 39 to guide the bases of the cam rollers 43; a pair of cam axes 57 for extension/retraction which is supported on the outer surface of the expanding cylinder 39*b* so as to freely rotate about an axis parallel to the in-and-out axis OP and has cam grooves 57*a* formed on the outer peripheral surfaces thereof, the cam grooves 57*a* being engaged with the leading ends of the cam rollers 43; and bit extending/retracting handles 58 for rotating the extending/retracting cam axes 57 via worm gears 58*a*, driving shafts 58*b*, and driving mechanisms with wrapping connectors 58*c*.

The bit extending/retracting mechanism 55 may be composed of a linear drive device such as a feed screw mechanism, a hydraulic cylinder, or an electric jack.

(Seal Structure)

Figure 10:
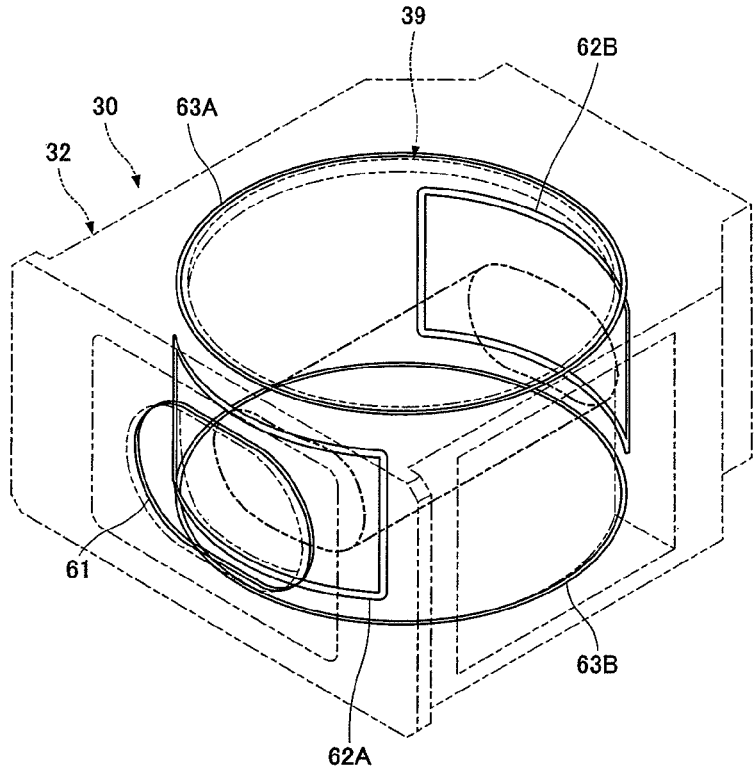
FIG. 10 is a perspective view illustrating sealing materials.

As shown in FIGS. 4 and 10, in the bit replacing unit 30, a plurality of sealing materials stop water to prevent water leakage into the workspace 28.

Specifically, a first sealing material 61 is provided on the outer periphery of the front end of the bit case 41. The first sealing material 61 stops water at a gap between the inner surface of the bit containing portion 34 of the housing 32 and the outer peripheral surface of the bit case 41 in an excavation position.

Second sealing materials 62A and 62B and third sealing materials 63A and 63B are provided on the rotary valve 39. The second sealing materials 62A and 62B are provided on the inner circumferential surface of the valve containing portion 35 so as to surround the opening surface and the rear opening surface of the valve containing portion 35 to seal a sliding gap between the inner circumferential surface of the valve containing portion 35 and the outer peripheral plate 39*a* of the rotary valve 39. The third sealing materials 63A and 63B are provided over the peripheries around two end surfaces of the outer peripheral plate 39*a* of the rotary valve 39 to seal the sliding gap between the outer peripheral plate 39*a* of the rotary valve 39 and the inner circumferential surface of the valve containing portion 35. Further, as shown in FIG. 9, a fourth sealing material 64 is attached over the outer peripheral surface of the block body 45 in the reactive force support block 44 to seal a gap between the reactive force support block 44 and the attachment/detachment path 38. A fifth sealing material 65 is attached over the outer periphery of the front end of the guide cylinder 46 to seal a gap between the guide cylinder 46 in the reactive force support block 44 and the soil removal path 42.

Thus, when the bit case 41 is located at an excavation position, muddy water and pebbles with a small diameter, which are about to flow into the gap between the rotary valve 39 and the valve containing portion 35, are prevented by the first sealing material 61 from flowing into the bit containing portion 34. Moreover, the second sealing materials 62A and 62B and the third sealing materials 63A and 63B prevent water leakage into the workspace 28.

In the retraction position of the bit case 41, the first sealing material 61 seals a gap between the inner surface of the attachment/detachment path 38 and the bit case 41. The second sealing materials 62A and 62B and the third sealing materials 63A and 63B prevent water leakage from the gap between the rotary valve 39 and the valve containing portion 35 into the workspace 28. Even when the rotary valve 39 is turned by 90° from the use position to the replacement position, the second sealing materials 62A and 62B, the third sealing materials 63A and 63B, the fourth sealing material 64, and the fifth sealing material 65 prevent water leakage into the workspace 28.

(Replacement of Roller Bit)

The procedure for replacing the roller bit 31 in the above configuration will be described.

1) When the abraded roller bit 31 is replaced at an excavation position where the bit case 41 is contained in the bit containing portion 34, the cutter head 16 is stopped at a predetermined position, operators enter the workspace 28 in the main spoke member 21 from the manhole 27 to replace the roller bit 31.

2) After the pair of cotters 48 is removed from the cotter inserting holes 40, the bit extending/retracting handle 58 is operated to rotate the extending/retracting cam axis 57, so that the bit case 41 is retracted from the excavation position to the retraction position of the attachment/detachment path 38 via the cam rollers 43.

3) The valve rotating handle 54 is operated to turn the rotary valve 39 by 90° from the use position to the replacement position, thereby causing the rear opening of the attachment/detachment path 38 to face the opening for replacement 37.

4) The door for replacement 37*a* is opened, and an operating tool such as a jack is used to draw out the reactive force support block 44 in the direction of the tangent axis OE from the attachment/detachment path 38 to the workspace 28 via the opening for replacement 37. Next, the bit case 41 is retracted to the rear opening side, the cam rollers 43 are detached from the bit case 41 and removed from the guide holes 56, and then the bit case 41 is drawn out from the attachment/detachment path 38 to the workspace 28 through the opening for replacement 37.

5) The bit case 41 with another roller bit 31 mounted thereon is inserted into the attachment/detachment path 38 from the opening for replacement 37, the cam rollers 43 are attached to the bit case 41 and pushed into the inner side of the attachment/detachment path 38, and the cam rollers 43 are fitted into the guide holes 56 and engaged with the cam grooves 57*a* of the extending/retracting cam axes 57. Further, the reactive force support block 44 is fitted from the workspace 28 into the attachment/detachment path 38 via the opening for replacement 37.

6) After the door for replacement 37*a* is closed, the valve rotating handle 54 is operated to turn the rotary valve 39 by 90° from the replacement position to the use position to align the front opening of the attachment/detachment path 38 with the bit containing portion 34.

7) The bit extending/retracting handle 58 is operated to rotate the extending/retracting cam axes 57, the bit case 41 is moved from the retraction position of the attachment/detachment path 38 in the direction of the in-and-out axis OP via the cam rollers 43 so as to protrude into the bit containing portion 34, and stops at the excavation position. Further, the cotters 48 are inserted from the cotter inserting holes 40 and fitted between the rear surface of the bit case 41 and the reactive force receiving surface 45*a* of the reactive force support block 44 to fix the bit case 41.

According to the first embodiment, the bit case 41 contained in the attachment/detachment path 38 of the rotary valve 39 is moved so as to protrude into the bit containing portion 34 which opens at the front surface of the main cutter spoke 21, and is fixed to excavate soil. Thus, the sliding gap of the rotary valve 39 in the valve containing portion 35 is closed by the bit case 41, is not exposed to the front surface of the main cutter spoke 21, and is not directly subjected to the muddy water pressure of an excavated portion.

The first sealing material 61 surrounding the bit case 41 and the second sealing material 62A surrounding the front opening of the valve containing portion 35 favorably stop water at the sliding gaps. Thus, muddy water pressure is not directly applied to the sliding gap of the rotary valve 39 and fragments do not flow into the sliding gap. This enables the sliding gap between the rotary valve 39 and the valve containing portion 35 to be favorably sealed, thereby increasing sealing properties. Hence, the rotary valve 39 can be smoothly rotated.

The excavating reactive force transferred from the bit case 41 to the rear surface of the attachment/detachment path 38 via the cotters 48 can be supported by the reactive force support plug 32E of the housing 32 via the reactive force support block 44. Thus, a large excavating reactive force applied to the roller bit 31 can be effectively supported.

The reactive force support block 44 is removed from the attachment/detachment path 38 and the bit case 41 is then removed from the attachment/detachment path 38, so that the roller bit 31 can be easily replaced.

Soil excavated by the roller bit 31 can be smoothly discharged from the soil removal path 42 to the duct for soil removal 21D via the soil removal path 47 and the soil removal path 49, so that rocks and pebbles can be favorably crushed.

Modified Example of First Embodiment

Figure 17:
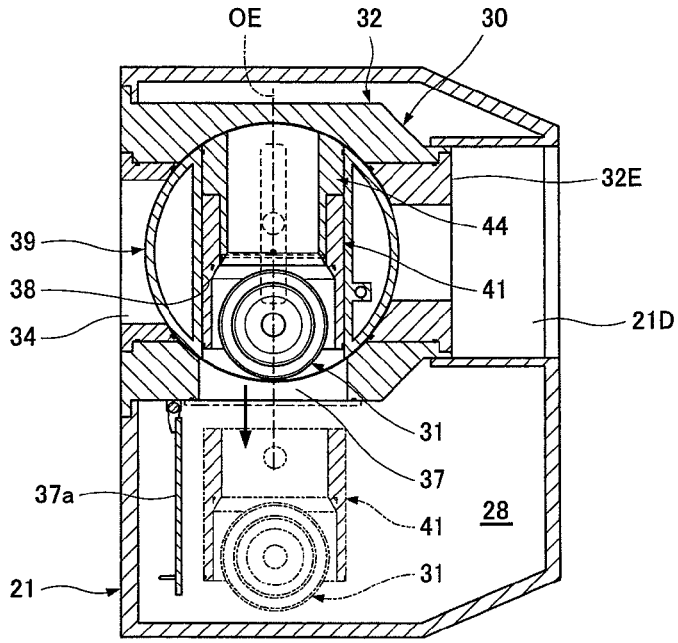
FIG. 17 is a central cross-sectional view of the bit replacing unit illustrating a state in which the bit case is removed out in the replacement of the roller bit according to a modified example of the first embodiment.

FIG. 17 shows that the rotary valve 39 is turned by 90° in an opposite direction to the turning direction of the rotary valve 39 in the first example. Only the bit case 41 can be first removed. The cam rollers 43 obstruct the replacement of the bit case 41. However, this problem can be solved by detaching the cam rollers 43 after the extending/retracting cam axes 57 of the bit extending/retracting mechanism 55 are detached. In this modified example, the reactive force support block 44 can be fixed to the rotary valve 39 or the reactive support block 44 and the rotary valve 39 can be integrated.

According to the modified example of the first embodiment, in addition to the effects of the first embodiment, the roller bit 31 can be further easily replaced only by removing the bit case 41.

Second Embodiment

A second embodiment of the bit replacing unit will be described with reference to FIGS. 18 to 20. The same members as those in the first embodiment are indicated by the same reference numerals, and an explanation thereof is omitted.

Bit replacing units 70 are disposed on left and right sides of a main cutter spoke 21, and a rotary valve 75 contained in a housing 71 is rotated about a tangent axis (rotary axis) OE to replace a roller bit 31 from above or below.

Figure 18:
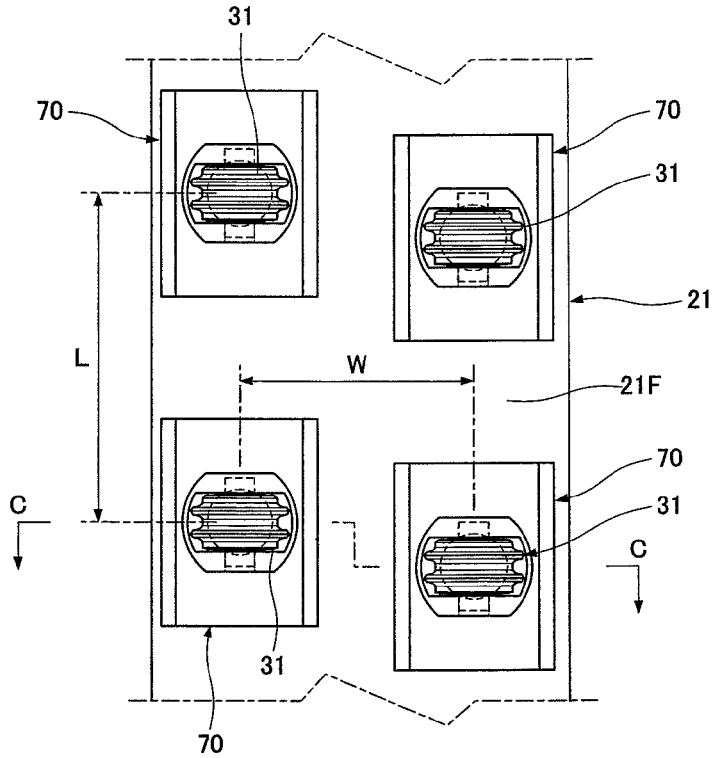
FIG. 18 is a front view of a main cutter spoke illustrating the arrangement of bit replacing units according to a second embodiment of the present invention.

As shown in FIG. 18, for shifting the excavation position and keeping a workspace 28 inside the main cutter spoke 21, the bit replacing units 70 are disposed at interval L in the direction of a radial axis (insertion-and-removal axis) OR and at interval W in the direction of the tangent axis OE, and when the main cutter spoke 21 is viewed from the front, the roller bits 31 on the left and right are displaced in the radial direction in a zigzag pattern.

Figure 20:
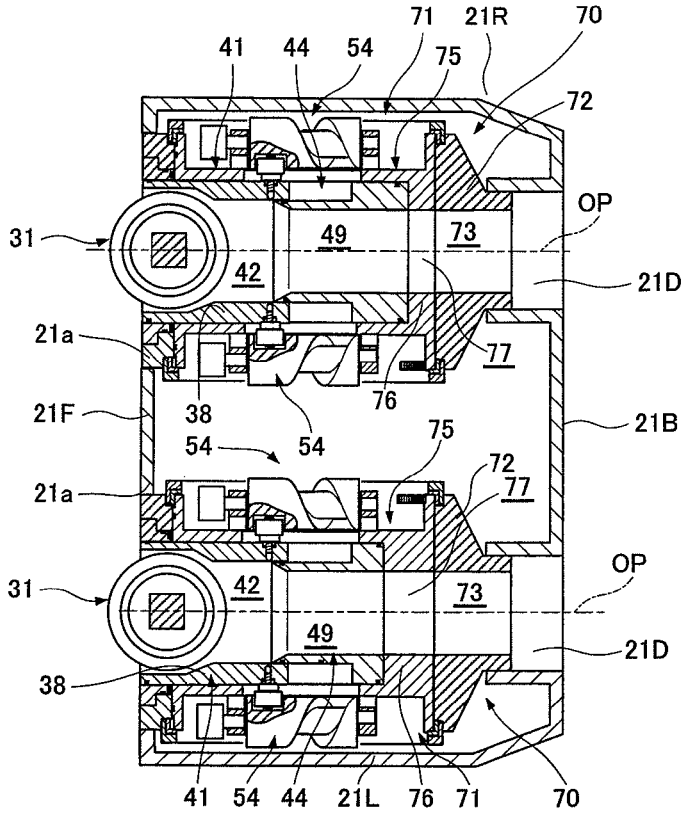
FIG. 20 is a cross-sectional view taken along the arrows C-C of FIG. 18.

As shown in FIGS. 20 and 21, a bit containing portion 34 and a valve containing portion 35 are formed, in this order from the front surface of the housing 71, on a bit containing path 33 penetrating through the housing 71. A reactive force support portion 72 is formed integrally with the housing 71 on the rear surface side of the valve containing portion 35. A soil removal path 73 is formed on the axial center portion of the reactive force support portion 72. A reactive force receiving portion 76 is integrally formed on the rear surface side of an attachment/detachment path 38 of the rotary valve 75 to prevent a reactive force support block 44 from being removed. A communicating soil removal path 77 is formed on the axial center portion of the reactive force receiving portion 76. Thus, an excavating reactive force applied to the roller bit 31 can be entirely supported by the rotary valve 75 via the bit case 41, the reactive force support block 44, and the reactive force receiving portion 76. Moreover, the excavating reactive force can be supported by the housing 71 from the rotary valve 75 via the reactive force support portion 72.

An opening for replacement 76 having an opening/closing door 76*a* is formed on one side in the direction of the radial axis OR (on the outer peripheral surface) [or on the other side (on the surface on the shield axial center O side)] of the housing 71.

Figure 19:
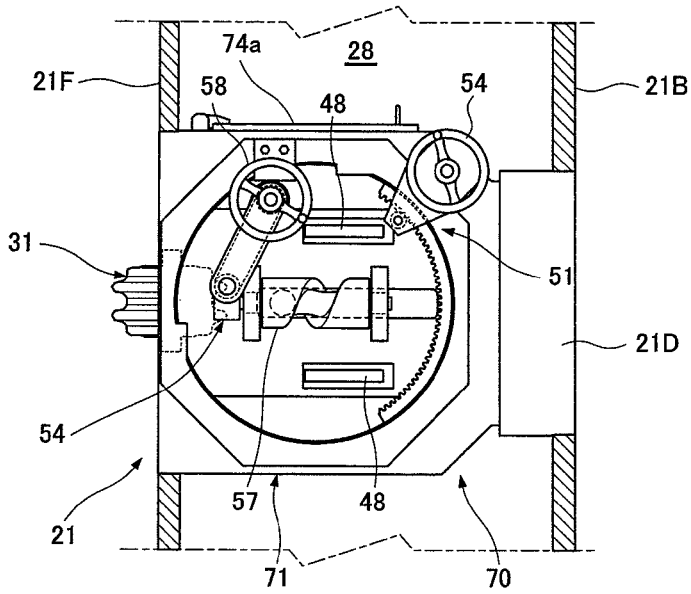
FIG. 19 is a longitudinal sectional view of the main cutter spoke.

As shown in FIG. 19, the bit replacing unit 70 includes a valve rotating mechanism 51 for rotating the rotary valve 75 about the tangent axis OE and a bit extending/retracting mechanism 54 for extending and retracting the roller bit 31 between an excavation position and a retraction position, the valve rotating mechanism 51 and the bit extending/retracting mechanism 54 having the same structures as those in the first embodiment.

Figure 21A:
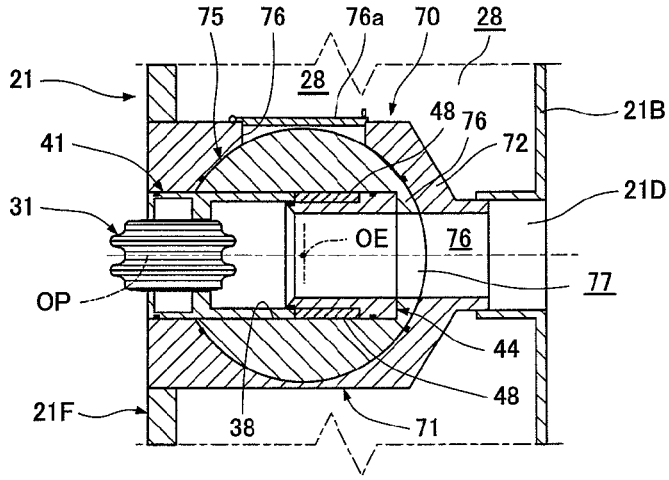
FIG. 21A is a central longitudinal sectional view of the bit replacing unit illustrating the excavation position of a roller bit.
Figure 21B:
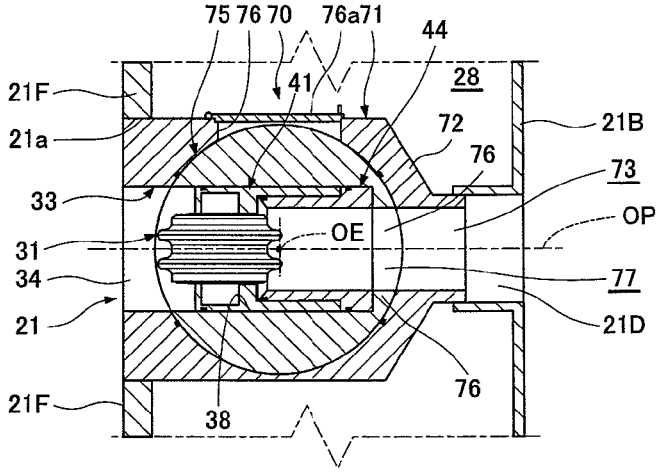
FIG. 21B is a central longitudinal sectional view of the bit replacing unit illustrating the retraction position of a bit case.
Figure 21C:
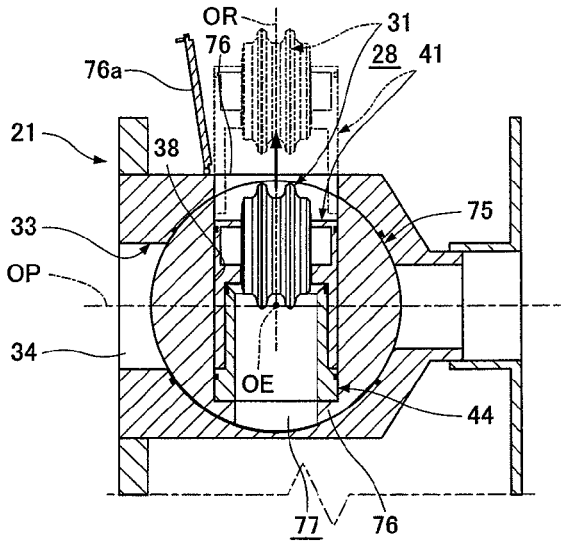
FIG. 21C is a central longitudinal sectional view of the bit replacing unit illustrating a state in which the bit case is removed out.

In the above configuration, as shown in FIGS. 21A to 21C, the bit extending/retracting mechanism 54 retracts the rotary valve 75 from the bit containing portion 34 in the excavation position into the attachment/detachment path 38 in the retraction position. The valve rotating mechanism 51 rotates the rotary valve 75 by 90° about the tangent axis OE, thereby causing the front surface of the attachment/detachment path 38 to face the opening for replacement 76. Thus, as in the modified example of the first embodiment, the bit case 41 can be removed out from the opening for replacement 76 into the workspace 28.

According to the second embodiment, the same effects as the first embodiment and the modified example can be produced. Further, multiple bit replacing units 70 can be disposed on the main cutter spoke 21, which is preferable to a large excavating machine.

The invention claimed is:

1. A bit replacing unit for an excavating machine, in which the excavating machine includes, in a front part thereof, a cutter head rotatably supported about an excavating machine axial center, a roller bit for crushing rocks and pebbles, the roller bit being disposed on a front surface of the cutter head, and a workspace in which an abraded roller bit can be replaced, the workspace being formed inside the cutter head, wherein a housing is disposed in a front part of the cutter head, a bit containing path is formed in the housing along an in-and-out axis along which the roller bit is extended and retracted, a bit containing portion which opens at the front surface of the cutter head and a valve containing portion which is formed behind the bit containing portion are provided on the bit containing path, an opening for replacement is formed in a direction of an insertion-and-removal axis at a predetermined angle relative to the in-and-out axis in the housing, the opening for replacement communicating with the valve containing portion and the workspace, a rotary valve is provided in the valve containing portion, the rotary valve being rotatable about a rotary axis substantially perpendicular to the in-and-out axis and the insertion-and-removal axis, an attachment/detachment path communicating with the bit containing portion is formed in the rotary valve, a bit case containing the roller bit is removably inserted into the attachment/detachment path, the rotary valve is turned at a predetermined angle to cause the attachment/detachment path to communicate with the opening for replacement, so that the bit case is movable between the attachment/detachment path and the workspace, a bit extending/retracting mechanism for extending and retracting the bit case between the attachment/detachment path and the bit containing portion is provided on the rotary valve, a first sealing material is provided for sealing at a gap between the bit case and the valve containing portion, and a second sealing material is provided for sealing at a gap between a periphery of an opening of the attachment/detachment path and an inner surface of the valve containing portion on an outer peripheral surface of the rotary valve.

2. The bit replacing unit for an excavating machine according to claim 1, wherein a reactive force support block is provided on a rear surface side of the bit case in the attachment/detachment path of the rotary valve, the reactive force support block transferring an excavating reactive force of the roller bit to the housing, and a cotter for transferring the excavating reactive force is removably fitted between the bit case and the reactive force support block in the valve containing portion.

3. The bit replacing unit for an excavating machine according to claim 1 or 2, wherein the bit containing path penetrates through the cutter head, the attachment/detachment path penetrates through the rotary valve, the reactive force support block is removably inserted into the attachment/detachment path, and the reactive force support block is removably inserted into the workspace from a rear opening of the attachment/detachment path of the rotary valve via the opening for replacement.

4. The bit replacing unit for an excavating machine according to claim 3, wherein a first soil removal path containing the roller bit penetrates through the bit case in a direction of the in-and-out axis, a second soil removal path communicating with the first soil removal path penetrates through the reactive force support block in the direction of the in-and-out axis, and soil excavated by the roller bit can be discharged from the first soil removal path to a rear surface side of the cutter head via the second soil removal path.

* * * * *